US010950185B2

(12) United States Patent
Ko et al.

(10) Patent No.: US 10,950,185 B2
(45) Date of Patent: Mar. 16, 2021

(54) ORGANIC LIGHT-EMITTING DISPLAY DEVICE HAVING DEGRADATION COMPENSATION

(71) Applicant: TLI Inc., Seongnam-si (KR)

(72) Inventors: Jae Gan Ko, Seongnam-si (KR); Ju Hyun Park, Yongin-si (KR)

(73) Assignee: TLI INC., Seongnam-si (KR)

( * ) Notice: Subject to any disclaimer, the term of this patent is extended or adjusted under 35 U.S.C. 154(b) by 0 days.

(21) Appl. No.: 16/827,023

(22) Filed: Mar. 23, 2020

(65) Prior Publication Data

US 2020/0349894 A1 Nov. 5, 2020

(30) Foreign Application Priority Data

May 1, 2019 (KR) ..... 10-2019-0051133

(51) Int. Cl.
*G09G 3/3233* (2016.01)
*G09G 3/3291* (2016.01)
*G09G 3/00* (2006.01)

(52) U.S. Cl.
CPC ..... *G09G 3/3291* (2013.01); *G09G 3/006* (2013.01); *G09G 2320/045* (2013.01); *G09G 2330/12* (2013.01)

(58) Field of Classification Search
CPC ..... G09G 2320/0233; G09G 3/3233; G09G 2320/045; G09G 2320/048; G09G 2320/0285; G09G 2320/043; G09G 3/3208; G09G 2320/029; G09G 2320/0295; G09G 2320/046; G09G 2330/10; G09G 2320/0693; G09G 2300/0413; G09G 2320/0271; G09G 2340/0457; G09G 2340/16; G09G 2320/06
USPC ..... 345/76–79
See application file for complete search history.

(56) References Cited

U.S. PATENT DOCUMENTS

| | | | | |
|---|---|---|---|---|
| 8,497,857 | B2 | 7/2013 | Nakamura | |
| 9,928,773 | B2 * | 3/2018 | Kim | G09G 3/3208 |
| 10,650,741 | B2 * | 5/2020 | Zhang | G09G 3/3208 |
| 10,783,814 | B2 * | 9/2020 | Chaji | G09G 3/32 |

* cited by examiner

*Primary Examiner* — Duc Q Dinh
(74) *Attorney, Agent, or Firm* — Kile Park Reed & Houtteman PLLC

(57) ABSTRACT

An organic light-emitting display (OLED) device includes an image display member, an aging display member, a degradation compensation control member for compensating for degradation of original image data of display pixels of the image display member. Aging pixels of the aging display member are degraded by reflecting image driving data of the display pixels, and the degradation of the original image data is compensated depending on degradation confirmation values of standard cumulative stress indexes corresponding to cumulative stress of the display pixels. The degree of degradation of the pixels may be accurately reflected while having a high aperture ratio, so that effective degradation compensation may be performed.

12 Claims, 10 Drawing Sheets

FIG. 9

IFDE

| | RPST | FVA (V) | PVA (V) | CVA (V) |
|---|---|---|---|---|
| 1 | 10 | 0.10 | 1.0 | 10 |
| 2 | 15 | 0.12 | 1.2 | 12 |
| ASTd<i> → 3 | 20 | 0.13 | 1.3 | 13 |
| 4 | 22 | 0.13 | 1.3 | 13 |
| 5 | 27 | 0.17 | 1.7 | 17 |
| ⋮ | ⋮ | ⋮ | ⋮ | ⋮ |

IFSN (VSEN)

ORGANIC LIGHT-EMITTING DISPLAY DEVICE HAVING DEGRADATION COMPENSATION

CROSS-REFERENCE TO RELATED APPLICATION

This application claims priority to and the benefit of Korean Patent Application No. 10-2019-0051133, filed on May 1, 2019, the disclosure of which is incorporated herein by reference in its entirety.

BACKGROUND

1. Field of the Invention

The disclosure relates to an organic light-emitting display (OLED) device, and more particularly, to an OLED device capable of compensating for degradation of an organic light-emitting diode.

2. Discussion of Related Art

In general, luminance uniformity between pixels of a display panel is deteriorated due to degradation variation between the pixels. The degradation of the pixels is caused by, for example, the accumulation of stress due to driving time, driving voltage, and the like. The cumulative stress between the pixels may be different. Even when the same driving current according to the same driving data is supplied to an organic light-emitting diode of each of the pixels, the degradation variation is generated due to the difference of the cumulative stress, and as a result, luminance variation is generated between the pixels.

Such degradation variation between the pixels results in an image sticking phenomenon and serves as a factor for deteriorating the quality of displayed images. Accordingly, in order to mitigate the deterioration of the image quality due to the degradation, organic light-emitting display (OLED) devices generally have degradation compensation features.

One degradation compensation method is confirming the cumulative stress of a display pixel and then estimating and compensating for degradation according to the confirmed cumulative stress. Such a method has a disadvantage in that sensing pixels are not disposed in a displayed area, and thus a aperture ratio is high as a whole but does not accurately reflect the degree of degradation of each of display pixels.

Another degradation compensation method is to directly sense the degree of degradation of each pixel and compensate for the degradation according to the sensed degree of degradation. Such a method has an advantage of accurately reflecting the degree of degradation of the pixels but has a disadvantage of a complicated structure and a low aperture ratio.

SUMMARY

In the disclosure, described are embodiments of an organic light-emitting display (OLED) device having an efficient degradation compensation structures and functions.

In an embodiment, an OLED device includes an image display member including display pixels which are driven to display images for each frame in an image display operation and each of which is emission-accessed according to image driving data in the image display operation; an aging display member including aging pixels each of which is driven to read a degradation sensed value reflecting the degree of degradation of each aging pixel in a degradation sensing operation; and a degradation compensation control member that stores degradation correlation information representing a degradation confirmation value for each of standard cumulative stress indexes and being updated depending on the degradation sensed value. The degradation compensation control member compensating for degradation of original image data of each display pixel according to the degradation correlation information to provide image driving data of each display pixel. The aging pixels are driven to be degraded by reflecting the image driving data of the display pixels in each frame. The degradation of the original image data is compensated depending on the degradation confirmation values of the standard cumulative stress indexes corresponding to image cumulative stress indexes which represent cumulative stress of the display pixels.

The original aging data of each of the aging pixels in a current frame is determined based on a maximum data value among the original image data of each of the display pixels in the current frame.

The degradation compensation controller includes a cumulative stress storage unit that stores the image cumulative stress indexes of the display pixels and the aging cumulative stress indexes of the aging pixels, a stress confirmation update unit that updates the image cumulative stress indexes and the aging cumulative stress indexes stored in the cumulative stress storage unit by confirming image unit stress indexes of each of the display pixels and aging unit stress indexes of each of the aging pixels. Each of the image unit stress indexes corresponds to the original image data of each of the display pixels, and each of the aging unit stress indexes corresponds to the original aging data of each of the aging pixels. The degradation compensation controller includes a correlation confirmation unit that confirms a correlation between the aging cumulative stress index and the degradation sensed value of each of the aging pixels to generate sensing correlation information, and a degradation compensation unit that stores the degradation correlation information, compensates for the degradation of the original image data of each of the display pixels based on the degradation confirmation value for the standard cumulative stress index corresponding to the image cumulative stress index of each of the display pixels to generate the image driving data of each of the display pixels, compensates for the degradation of the original aging data of each of the aging pixels based on the degradation confirmation value for the standard cumulative stress index corresponding to the aging cumulative stress index of each of the aging pixels to generate the aging driving data of each of the aging pixels. The degradation correlation information of the degradation compensation unit is updated using the sensing correlation information.

The cumulative stress storage unit includes a volatile memory that stores the image cumulative stress indexes of the display pixels and the aging cumulative stress indexes of the aging pixels and communicates with the stress confirmation update unit, the correlation confirmation unit, and the degradation compensation unit, wherein the image cumulative stress indexes of each of the display pixels are updated depending on the corresponding image unit stress indexes, and the aging cumulative stress indexes of each of the aging pixels are updated depending on the corresponding aging unit stress indexes; and a non-volatile memory that stores the image cumulative stress indexes and the aging cumulative stress indexes even when power is off and communicates with the volatile memory.

The stress confirmation update unit includes a unit stress confirmation device that confirms the original image data of each of the display pixels to generate the image unit stress indexes of each of the display pixels and confirms the original aging data of each of the aging pixels to generate the aging unit stress indexes of each of the aging pixels; and a stress adding device that updates the image cumulative stress indexes of each of the display pixels by adding the image unit stress index of each of the display pixels and updates the aging cumulative stress indexes of each of the aging pixels by adding the aging unit stress indexes of each of the aging pixels.

The degradation compensation unit includes a degradation look-up table that stores the degradation correlation information and outputs the degradation confirmation value corresponding to the image cumulative stress index of each of the display pixels and the aging cumulative stress index of each of the aging pixels, a confirmed value amplifying device that generates an amplification confirmation value by amplifying the degradation confirmation value output from the degradation look-up table, and a degradation compensation device that compensates for the degradation of the original image data of each of the display pixels to generate the image driving data of each of the display pixels and compensates for the degradation of the original aging data of each of the aging pixels to generate the aging driving data of each of the aging pixels. The degradation of the original image data and the compensation for the degradation of the original aging data are compensated by the degradation compensation device based on the amplification confirmation values of the original image data and the original aging data, respectively, that are output from the confirmed value amplifying device.

The degradation compensation controller further includes a data setting signal generating unit that generates a data setting signal that is activated in a previous frame based on the image cumulative stress indexes and the aging cumulative stress indexes, and the aging data generator that determines the original aging data of each of the aging pixels in a current frame based on the image cumulative stress indexes and the aging cumulative stress indexes according to the activation of the data setting signal.

Each of the aging pixels of the aging display member emits light according to aging driving data in the image display operation, and the aging driving data of each of the aging pixels is determined based on the original image data of each of the display pixels.

The aging driving data of each of the aging pixels is generated by compensating for degradation of original aging data of each of the aging pixels, and the original aging data of each of the aging pixels is generated based on the original image data of each of the display pixels.

The original aging data of each of the aging pixels is generated based on the image cumulative stress indexes of each of the display pixels. The compensation for the degradation of the original aging data is performed depending on the degradation sensed values of the aging pixels.

BRIEF DESCRIPTION OF THE DRAWINGS

The above and other objects, features, and advantages of the disclosure will become more apparent to those of ordinary skill in the art by describing exemplary embodiments thereof in detail with reference to the accompanying drawings, in which:

FIG. 9 is a view for describing an example of degradation compensation for original image data of the display pixels.

DETAILED DESCRIPTION OF EMBODIMENTS

Embodiments of the disclosure will be described in more detail with reference to the accompanying drawings.

Figure 1:
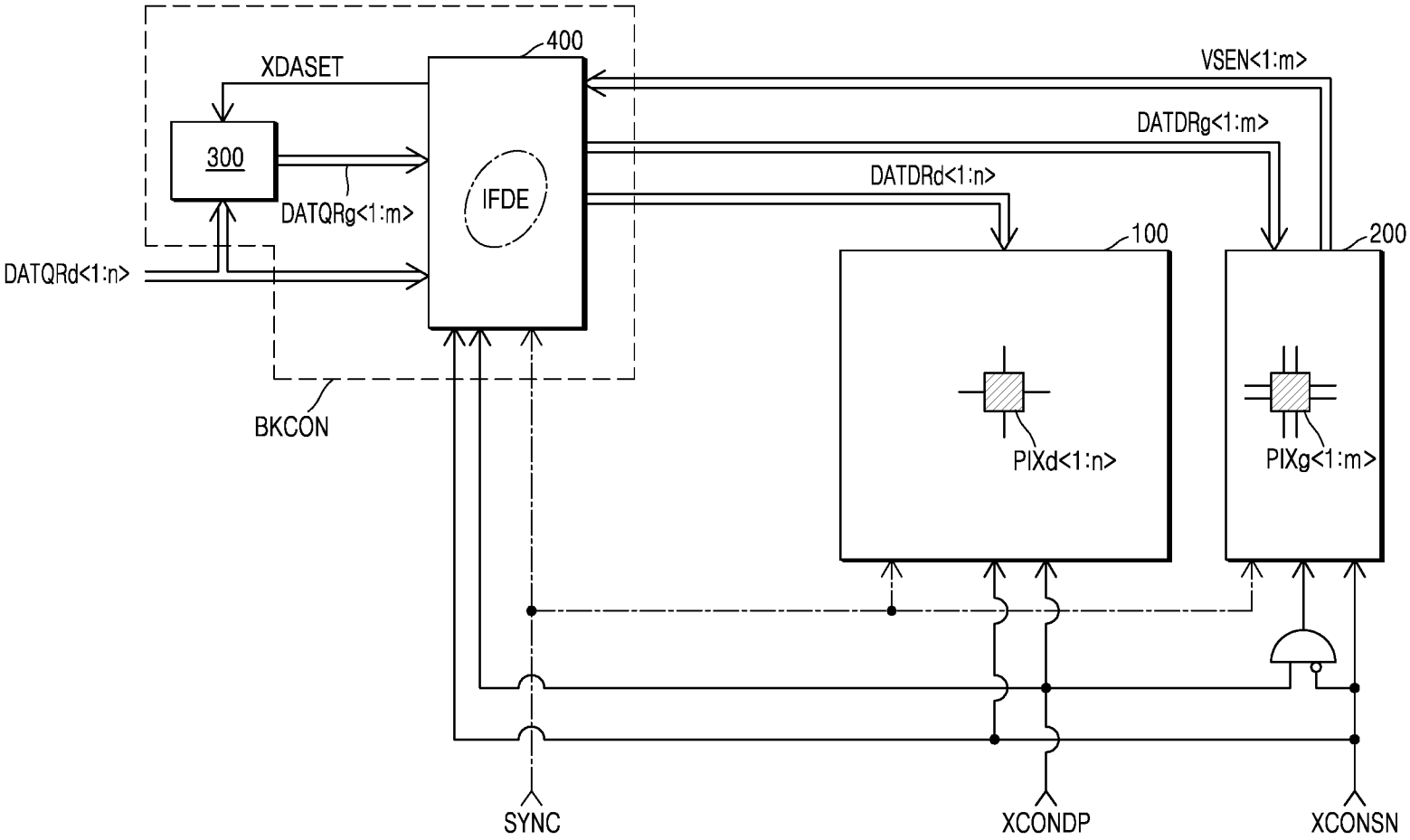
FIG. 1 is a schematic view illustrating an organic light-emitting display (OLED) device according to an embodiment.

FIG. 1 is a schematic view illustrating an organic light-emitting display (OLED) device having a degradation compensation function according to an embodiment.

The OLED device may perform an image display operation and a degradation sensing operation. In an embodiment, a display driving signal XCONDP is activated in the image display operation, and a sensing driving signal XCONSN is activated in the degradation sensing operation. The image display operation and the degradation sensing operation may be simultaneously performed.

A detailed description of various signals for performing the image display operation and the degradation sensing operation may be omitted for the purpose of simplicity of the description. Nevertheless, the omission of description of such signals does not reduce the scope of the disclosure.

In the description, data, stress indexes, values, and the like may be transmitted, for example, in a serial method through one or several signal lines. In the drawings, reference numeral "SYNC" illustrated by a dashed dotted line means that the corresponding elements or components among elements or components of the disclosure may be synchronized.

In an embodiment of FIG. 1, the OLED device includes an image display member 100, an aging display member 200, and a degradation compensation control member BKCON.

n display pixels PIXd <1:n>, which are driven to display images for each frame in the image display operation, are arranged in the image display member 100. In addition, m aging pixels PIXg <1:m> are arranged in the aging display member 200. In the embodiment, "n" and "m" are both natural numbers of 2 or more, and "m" may be smaller than "n".

Each of the display pixels PIXd <1:n> is emission-accessed according to image driving data DATDRd <1:n> thereof in the image display operation.

Each of the aging pixels PIXg <1:m> is degraded to reflect the degree of degradation of the display pixels PIXd <1:n>. Each of the aging pixels PIXg <1:m> is driven to be degraded by reflecting data values (distribution range) of the image driving data DATDRd <1:n> in each frame.

As a result, even when the OLED device is used for a long time, the aging pixels PIXg <1:m> are degraded by effectively reflecting the distribution of the degree of degradation of the display pixels PIXd <1:n>.

Each of the aging pixels PIXg <1:m> may be implemented to be emission-accessed independently from the emission-access of the display pixels PIXd <1:n>.

For example, the aging pixels PIXg <1:m> are emission-accessed mainly together with the display pixels PIXd <1:n> in the image display operation. However, when the degradation sensing operation is performed, the emission-access of the aging pixels PIXg <1:m> is blocked even when the image display operation is performed.

Each of the aging pixels PIXg <1:m> is emission-accessed according to aging driving data DATDRg <1:m> thereof. As such an emission-access is repeatedly performed, each of the aging pixels PIXg <1:m> is accessed to have different degrees of degradation from each other.

Each of the aging pixels PIXg <1:m> is driven to read degradation sensed values VSEN <1:m> thereof which are electrical components (e.g., voltage levels, current values, and the like) reflecting the degree of degradation in the degradation sensing operation.

In an embodiment, the degradation sensed values VSEN <1:m> are voltage levels. The voltage levels, which are the degradation sensed values VSEN <1:m>, may be obtained by integrating and converting the amount of current sensed from each of the aging pixels PIXg <1:m>.

Further, the degradation sensing operation is performed under certain conditions, such as during power-on, over a predetermined period of time, and the like.

As an example, the embodiment in which one aging pixel PIXg exists for each degree of degradation is illustrated and described. However, the embodiments are not limited thereto. In an embodiment, multiple aging pixels PIXg may exist for the same degree of degradation. In this case, the degradation sensed values VSEN <1:m> may be understood as an average of the degradation sensed values VSEN of each of the aging pixels PIXg for the same degree of degradation.

The degree of degradation of the display pixels PIXd and the aging pixels PIXg may depend on their own cumulative stress. In this case, unit stress of the display pixels PIXd and unit stress of the aging pixels PIXg may depend on the size of the image driving data DATDRd of the display pixels PIXd and the size of the aging driving data DATDRg of the aging pixels PIXg, respectively.

The display pixels PIXd and the aging pixels PIXg emit light with luminance according to values of the image driving data DATDRd and the aging driving data DATDRg thereof, respectively.

The higher the degree of degradation (that is, the cumulative stress) in the display pixels PIXd and the aging pixels PIXg, the lower the luminance for the image driving data DATDRd and the aging driving data DATDRg of the same value.

Still referring to FIG. 1, the degradation compensation control member BKCON stores degradation correlation information IFDE.

The degradation correlation information IFDE represents degradation confirmation values FVA for each of standard cumulative stress indexes RPST (see FIG. 9).

For example, the degradation confirmation values FVA are values that determine the degree of degradation as numerical values for each of the standard cumulative stress indexes RPST. As described below, the degradation confirmation values FVA are used as a basis for compensation of the luminance of the display pixels PIXd and the aging pixels PIXg.

The degradation confirmation values FVA of the degradation correlation information IFDE are updated depending on a degradation sensed value VSEN of each of the aging pixels PIXg.

The degradation compensation control member BKCON is driven to compensate for degradation of original image data DATQRd of each of display pixels PIXd of the image display member 100 according to the degradation correlation information IFDE to provide the image driving data DATDRd of each of the display pixels PIXd.

The degradation compensation for the original image data DATQRd is performed depending on the degradation confirmation values FVA of the standard cumulative stress indexes RPST corresponding to image cumulative stress indexes ASTd of the display pixels PIXd that correspond to the original image data DATQRd.

The image cumulative stress indexes ASTd represent the cumulative stress of the display pixels PIXd corresponding thereto.

When there is no standard cumulative stress indexes RPST that match the image cumulative stress indexes ASTd, the standard cumulative stress indexes RPST closest to the image cumulative stress indexes ASTd or the degradation confirmation values FVA of the standard cumulative stress indexes RPST calculated by interpolation based on two adjacent values is confirmed.

In the OLED device, the aging pixels PIXg for identifying the degree of degradation are disposed in a different area from the display pixels PIXd for displaying images. Thus, in the OLED device according to this embodiment, an aperture ratio is greatly improved.

Further, in the OLED device, the aging pixels PIXg are degraded by reflecting data values of the image driving data DATDRd of the display pixels PIXd in each frame. The degree of degradation is directly sensed through the aging pixels PIXg, and the degree of degradation sensed is reflected in degradation compensation for the display pixels PIXd. Thus, the accuracy of the degradation compensation for the display pixels is greatly improved.

As a result, the degree of degradation of the pixels may be accurately reflected while having a high aperture ratio, that is, effective degradation compensation may be performed.

Hereinafter, each of the components of the OLED device illustrated in FIG. 1 will be described in detail.

Figure 2:
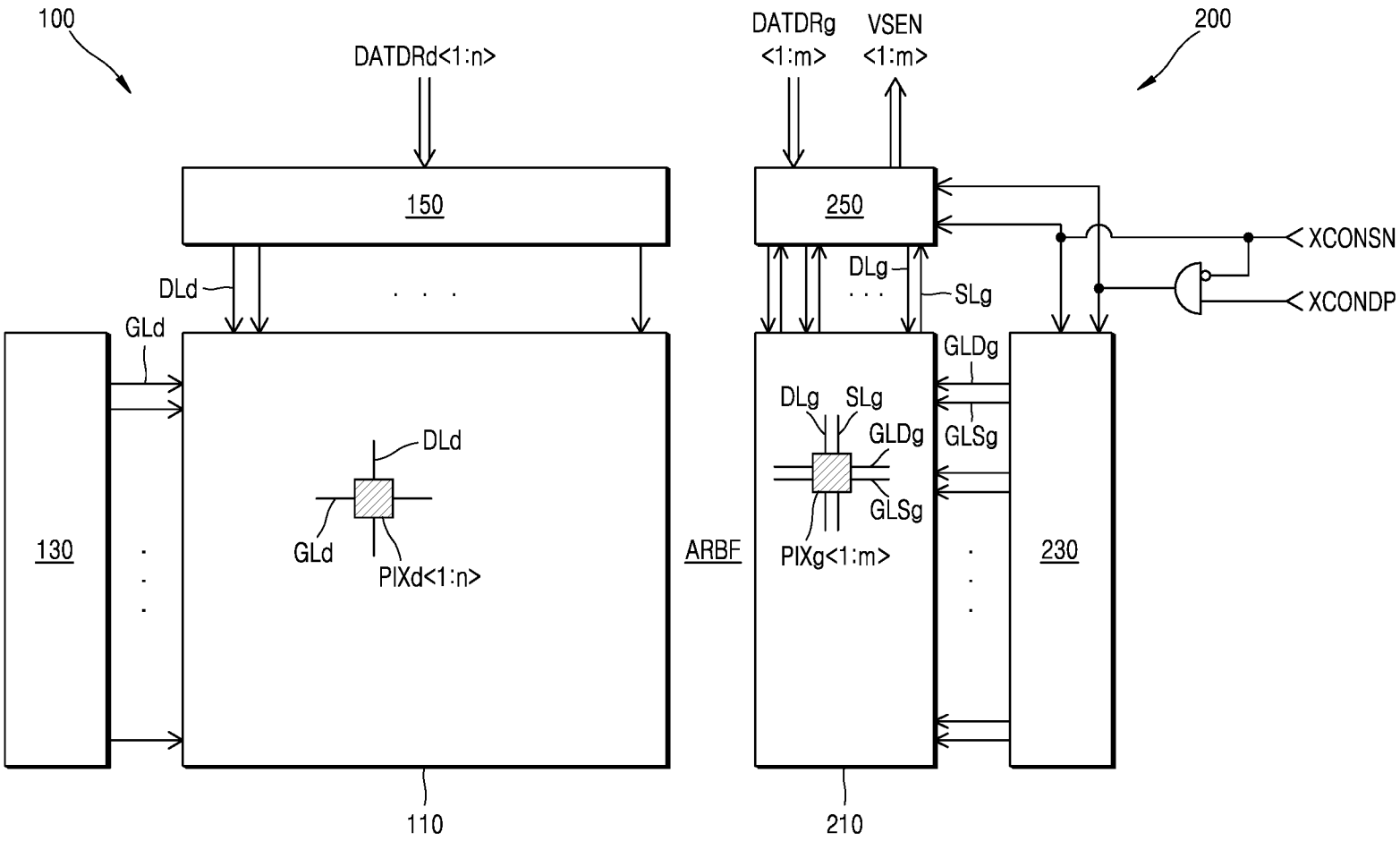
FIG. 2 is a schematic view illustrating an image display member and an aging display member of FIG. 1.

FIG. 2 is a schematic view illustrating the image display member 100 and the aging display member 200 of FIG. 1. Referring to FIG. 2, the image display member 100 includes an image display panel 110, an image gate driving circuit 130, and an image data driving circuit 150.

In the image display panel 110, the display pixels PIXd <1:n> are arranged in a matrix structure composed of image gate lines GLd and image data lines DLd. The image gate driving circuit 130 is driven to selectively activate the image gate lines GLd. The image data driving circuit 150 is driven to drive the image data lines DLd according to the image driving data DATDRd of each of the display pixels PIXd corresponding to the image data lines DLd.

Next, the driving of the display pixels PIXd is described.

Figure 3:
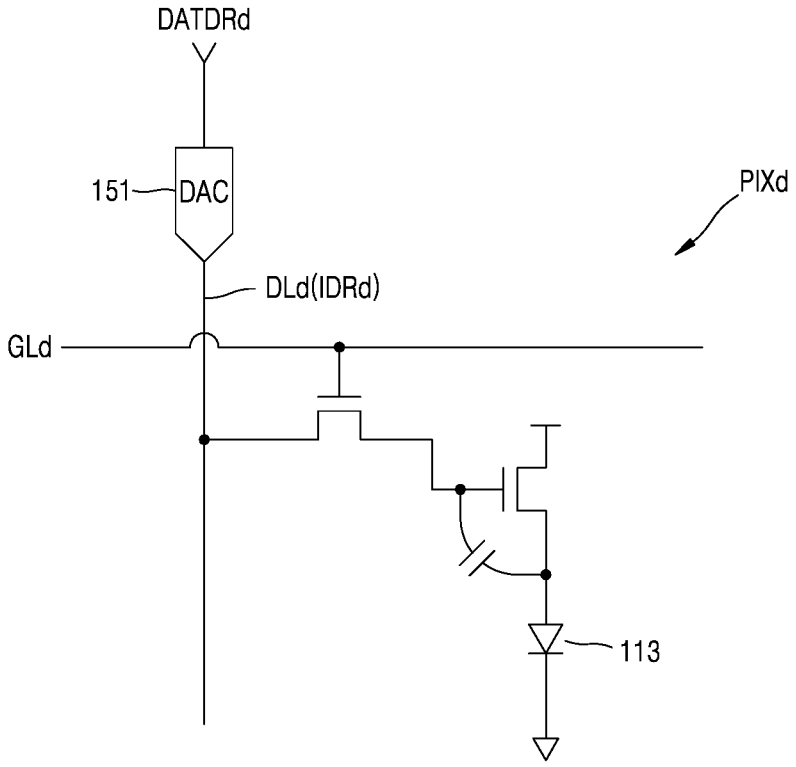
FIG. 3 is a schematic view for describing driving of display pixels illustrated in FIG. 2.

FIG. 3 is a schematic view for describing the driving of the display pixels PIXd illustrated in FIG. 2. FIG. 3 is to illustrate a configuration related to one display pixel PIXd.

The display pixel PIXd illustrated in FIG. 3 is the simplest embodiment. Embodiments are not limited thereto. For example, transistors represented by an n-channel metal-oxide-semiconductor (NMOS) may be configured as a p-channel metal-oxide-semiconductor (PMOS), and other elements for Vt compensation and the like may be provided.

Referring to FIG. 3, each of the display pixels PIXd includes an organic light-emitting diode 113 that emits light according to an image driving voltage of the organic light-emitting diode 113 when each of the display pixels PIXd is selected due to the activation of the corresponding image gate line GLd.

An image driving current IDRd of each of the display pixels PIXd has an amount of current in which the image driving data DATDRd is converted by a DAC 151 and transmitted through the corresponding image data lines DLd.

The organic light-emitting diode 113 of each of the display pixels PIXd is gradually degraded as the image display operation is repeatedly performed. The organic light-emitting diode 113 of each of the display pixels PIXd is degraded as the image driving current IDRd increases.

Referring to FIG. 2 again, the aging display member 200 includes an aging display panel 210, an aging gate driving circuit 230, and an aging data drive sensing circuit 250.

In the aging display panel 210, the aging pixels PIXg <1:m> are arranged in a matrix structure. Here, each of the aging pixels PIXg <1:m> is specified by aging display gate lines GLDg and aging data lines DLg when each of the aging pixels PIXg <1:m> is emission-accessed. In addition, in the degradation sensing operation, each of the aging pixels PIXg <1:m> is specified by aging sensing gate lines GLSg and aging sensing lines SLg.

The aging gate driving circuit 230 is driven to selectively activate the aging display gate lines GLDg in the image display operation. In addition, the aging gate driving circuit 230 is driven to selectively activate the aging sensing gate lines GLSg in the degradation sensing operation.

The aging data drive sensing circuit 250 is driven to drive the aging data lines DLg according to the aging driving data DATDRg of each of the aging pixels PIXg corresponding to the aging data lines DLg in the image display operation. In addition, the aging data drive sensing circuit 250 is driven to read the degradation sensed value VSEN of each of the aging pixels PIXg through the corresponding aging sensing lines SLg in the degradation sensing operation.

Next, the driving of the aging pixel PIXg is described.

Figure 4:
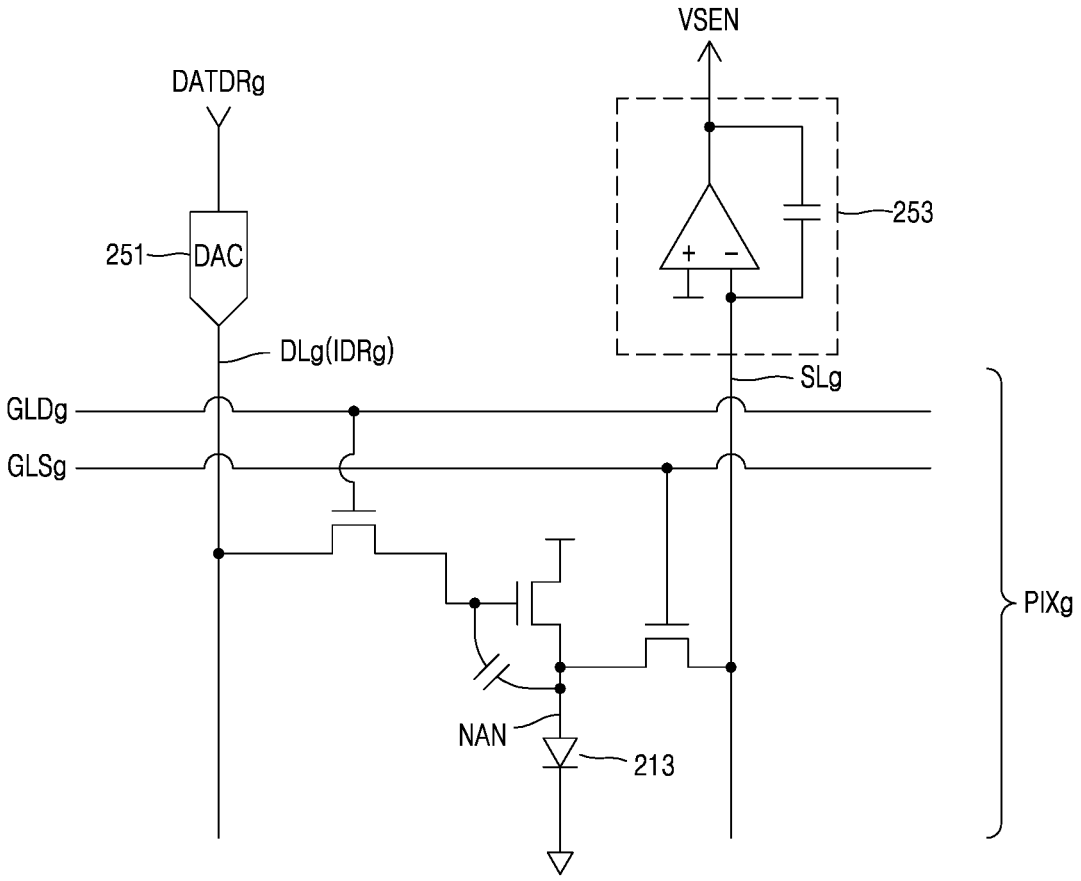
FIG. 4 is a schematic view for describing driving of aging pixels illustrated in FIG. 2.

FIG. 4 is a schematic view for describing driving of the aging pixel PIXg illustrated in FIG. 2. FIG. 4 is to illustrate a configuration related to one aging pixel PIXg.

Referring to FIG. 4, each of the aging pixels PIXg includes an organic light-emitting diode 213 that emits light according to an aging driving voltage of the organic light-emitting diode 213 when each of the aging pixels PIXg is selected due to the activation of the corresponding aging display gate line GLDg.

An aging driving current IDRg of each of the aging pixels PIXg has an amount of current in which the aging driving data DATDRg is converted by a DAC 251 and is transmitted through the corresponding aging data lines DLg.

The organic light-emitting diode 213 of each of the aging pixels PIXg is gradually degraded as the image display operation is repeatedly performed. In addition, the organic light-emitting diode 213 of each of the aging pixels PIXg is degraded as the aging driving current IDRg increases.

Further, each of the aging pixels PIXg transmits a voltage of an anode terminal NAN of the organic light-emitting diode 213 to the corresponding aging sensing line SLg when each of the aging pixels PIXg is selected due to the activation of the corresponding aging sensing gate line GLSg.

The voltage of the anode terminal NAN of the organic light-emitting diode 213 transmitted to the aging sensing line SLg is read out as the degradation sensed value VSEN through a read device 253 of the aging data drive sensing circuit 250.

In the OLED device, a blocking material may be formed on an upper surface of the aging display panel 210. Accordingly, the emission of light emitted from the aging pixels PIXg to the outside may be blocked by the blocking material.

The image display panel 110 and the aging display panel 210 may be implemented in the form of an integrated panel. A buffering region ARBF may be disposed between the image display panel 110 and the aging display panel 210. Thus, a phenomenon such as images displayed on the image display panel 110 are distorted due to the interference of light emitted from the aging pixels PIXg may be mitigated.

Referring to FIG. 1 again, the degradation compensation control member BKCON includes an aging data generator 300 and a degradation compensation controller 400.

The aging data generator 300 generates original aging data DATQRg of each of the aging pixels PIXg based on the original image data DATQRd of each of the display pixels PIXd.

The degradation compensation controller 400 stores the degradation correlation information IFDE.

The degradation compensation controller 400 compensates for the degradation of the original image data DATQRd of each of the display pixels PIXd using the degradation correlation information IFDE to generate the image driving data DATDRd of each of the display pixels PIXd.

The degradation compensation controller 400 compensates for degradation of the original aging data DATQRg of each of the aging pixels PIXg using the degradation correlation information IFDE to generate the aging driving data DATDRg of each of the aging pixels PIXg.

The compensation for the degradation of the original aging data DATQRg is performed according to the degradation correlation information IFDE, similarly to the compensation for the degradation of the original image data DATQRd.

Figure 8:
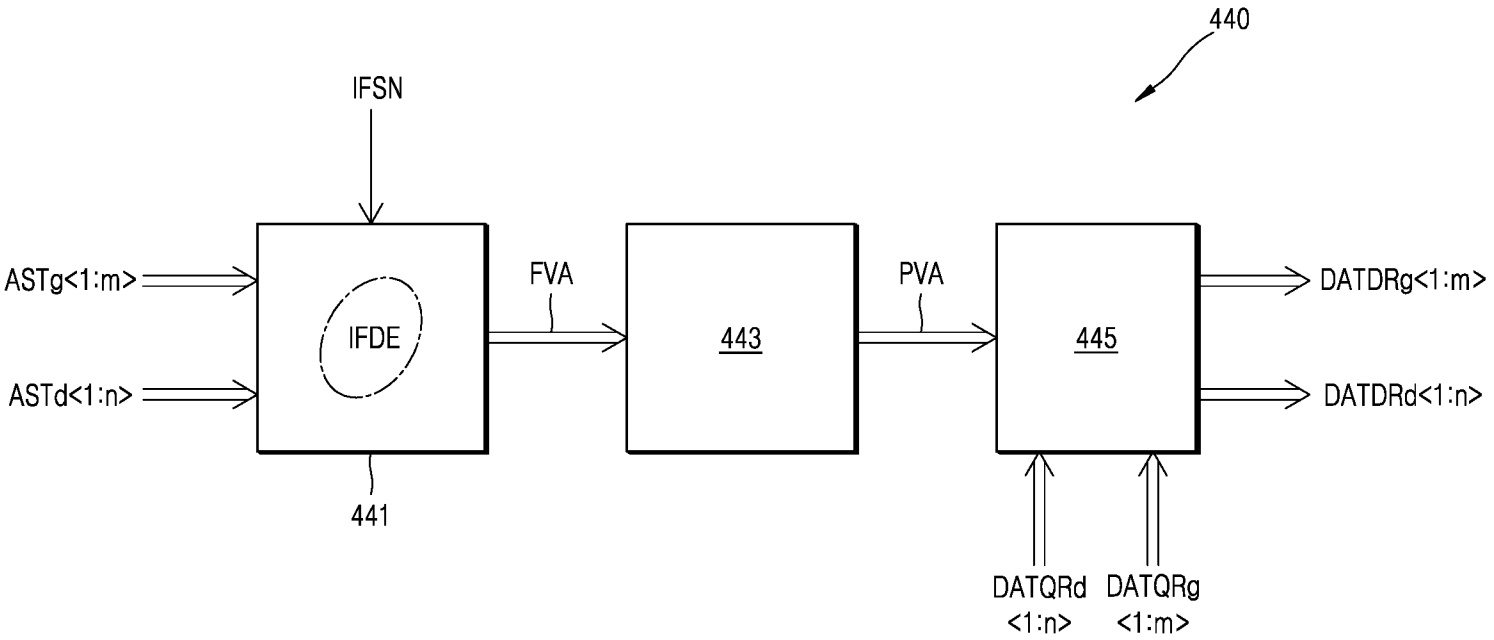
FIG. 8 is a schematic view illustrating a degradation compensation unit of FIG. 6.

The compensation for the degradation of the original aging data DATQRg is performed depending on the degradation confirmation value FVA of the standard cumulative stress indexes RPST corresponding to aging cumulative stress indexes ASTg of the aging pixels PIXg that correspond to the original aging data DATQRg (see FIG. 8).

Hereinafter, the original aging data DATQRg generated by the aging data generator 300 will be described.

The original aging data DATQRg of each of the aging pixels PIXg in a current frame (for example, a k-th frame) is determined based on a maximum data value of the original image data DATQRd of each of the display pixels PIXd in the current frame, the image cumulative stress index ASTd, the aging cumulative stress index ASTg, and the like.

As an example, assuming that the maximum data value in the original image data DATQRd of each of the display pixels PIXd is 255 and m is 9, original aging data DATQRg <1:9> of each of aging pixels PIXg <1:9> may be as shown in Table 1 below.

TABLE 1

| Original aging data | Data value |
|---|---|
| DATQRg<1> | 255 |
| DATQRg<2> | 223 |
| DATQRg<3> | 191 |
| DATQRg<4> | 159 |
| DATQRg<5> | 127 |
| DATQRg<6> | 95 |
| DATQRg<7> | 63 |
| DATQRg<8> | 31 |
| DATQRg<9> | 0 |

Figure 5:
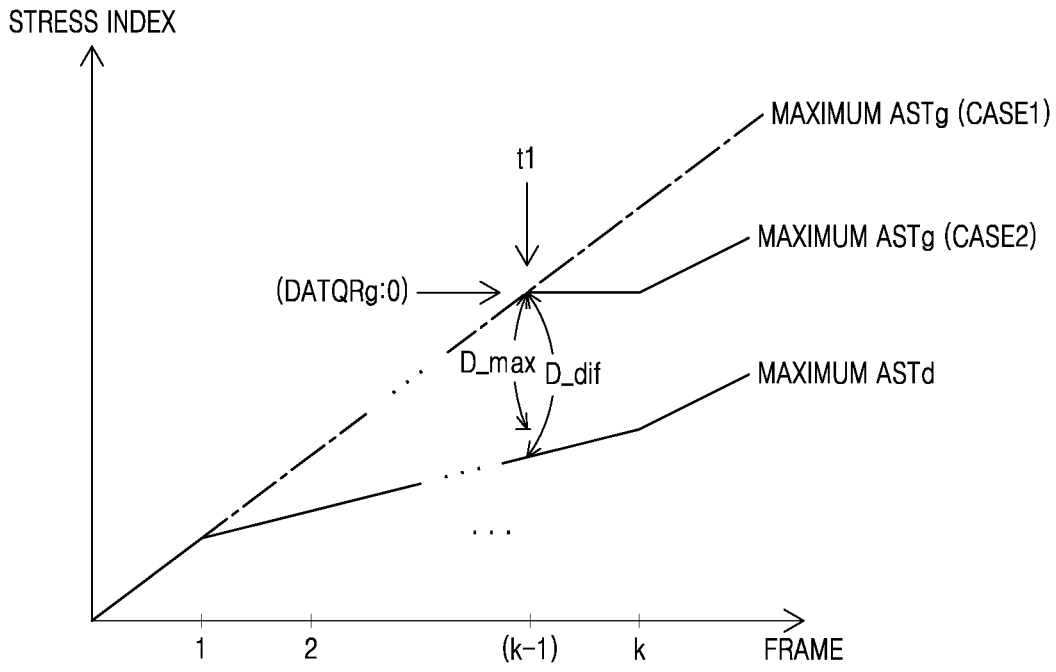
FIG. 5 is a graph for describing changes in the maximum value of image cumulative stress indexes and the maximum value of aging cumulative stress indexes.

In case that the original aging data DATQRg is generated in the same manner as in Table 1, as the image display operation is repeatedly performed, the difference between the maximum value among the image cumulative stress indexes ASTd of the display pixels PIXd and the maximum value among the aging cumulative stress indexes ASTg of the aging pixels PIXg gradually increases (see CASE1 in FIG. 5).

In this case, the original image data DATQRd may not always have a maximum value of 255 in a specific display pixel PIXd. The difference between the degree of degradation of an aging pixel PIXg <1> in which the worst case of degradation is prepared and the degree of degradation of the specific display pixel PIXd becomes larger.

Accordingly, the interval between the aging cumulative stress indexes ASTg of the aging pixels PIXg may be increased, and the effect of the degradation compensation may not be desirable in this case.

In order to improve the degradation compensation, in an exemplary embodiment, the original aging data DATQRg of each of the aging pixels PIXg is based on the image cumulative stress indexes ASTd of the display pixels PIXd and the aging cumulative stress indexes ASTg of the aging pixels PIXg.

For example, when a data setting signal XDASET is activated, the original aging data DATQRg of each of the aging pixels PIXg in the current frame is determined as basic data (e.g., 0) (see CASE2).

The data setting signal XDASET may be activated (see t1 in FIG. 5) when a difference D_dif between a maximum value Dmax_d among the image cumulative stress indexes ASTd of the display pixels PIXd and the maximum value among the aging cumulative stress indexes ASTg of the aging pixels PIXg exceeds an allowable range D_max in a "previous frame (e.g., (k−1)-th frame)."

In this case, the original aging data DATQRg <1:9> of each of the original aging pixels PIXg <1:9> may be as shown in Table 2 below.

TABLE 2

| Original aging data | Data value |
|---|---|
| DATQRg<1> | 0 |
| DATQRg<2> | 0 |
| DATQRg<3> | 0 |
| DATQRg<4> | 0 |
| DATQRg<5> | 0 |
| DATQRg<6> | 0 |
| DATQRg<7> | 0 |
| DATQRg<8> | 0 |
| DATQRg<9> | 0 |

As shown in Table 2, since the original aging data DATQRg of each of the aging pixels PIXg is determined as the basic data, the increasing of the interval between the aging cumulative stress indexes ASTg of the aging pixels PIXg may be mitigated.

Hereinafter, the degradation compensation controller 400 is described in detail.

Figure 6:
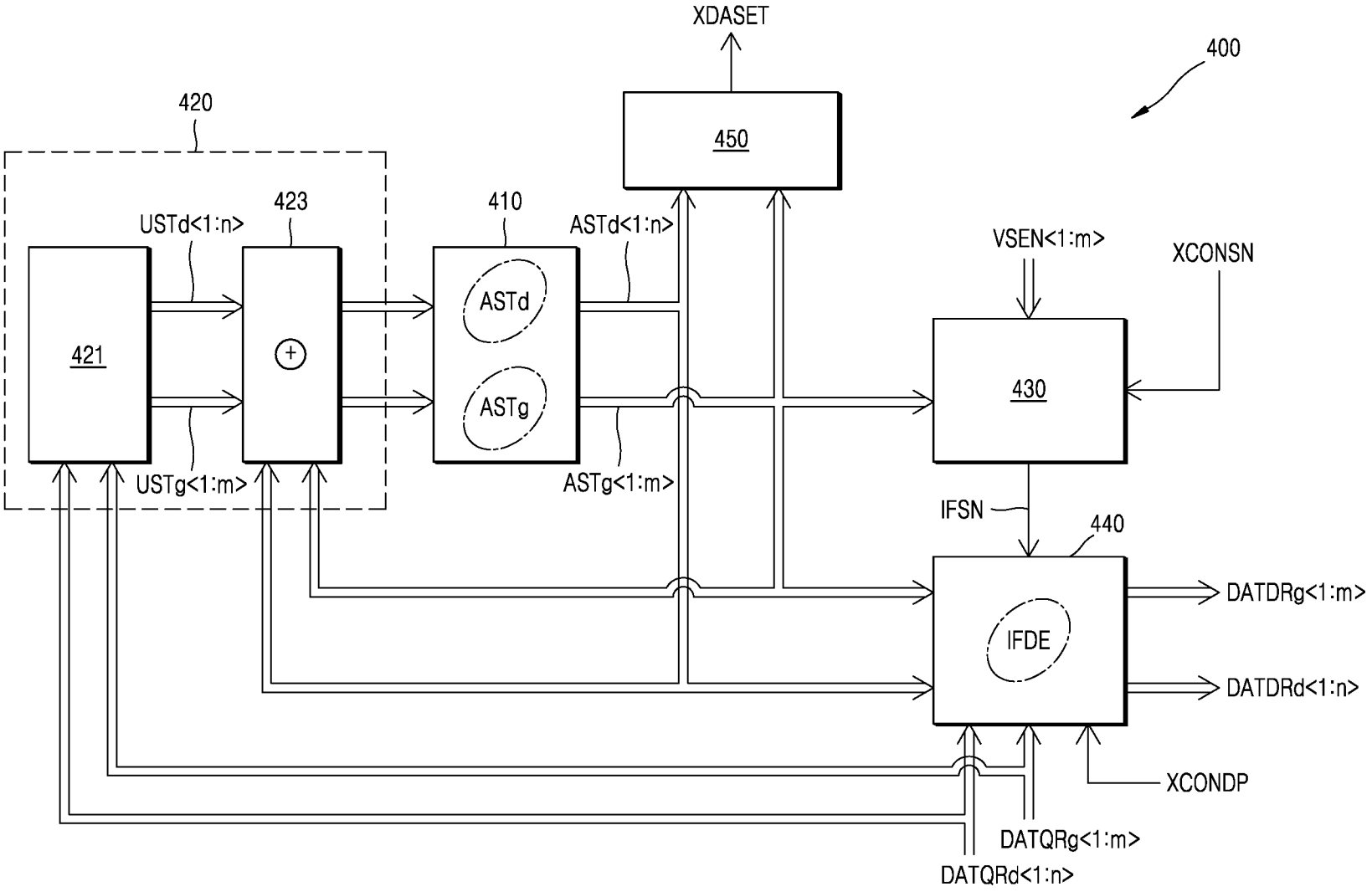
FIG. 6 is a schematic view illustrating a degradation compensation controller of FIG. 1.

FIG. 6 is a schematic view illustrating the degradation compensation controller 400 of FIG. 1. Referring to FIG. 6, the degradation compensation controller 400 includes a cumulative stress storage unit 410, a stress confirmation update unit 420, a correlation confirmation unit 430, a degradation compensation unit 440, and a data setting signal generating unit 450.

The cumulative stress storage unit 410 stores the image cumulative stress indexes ASTd of the display pixels PIXd and the aging cumulative stress indexes ASTg of the aging pixels PIXg.

Figure 7:
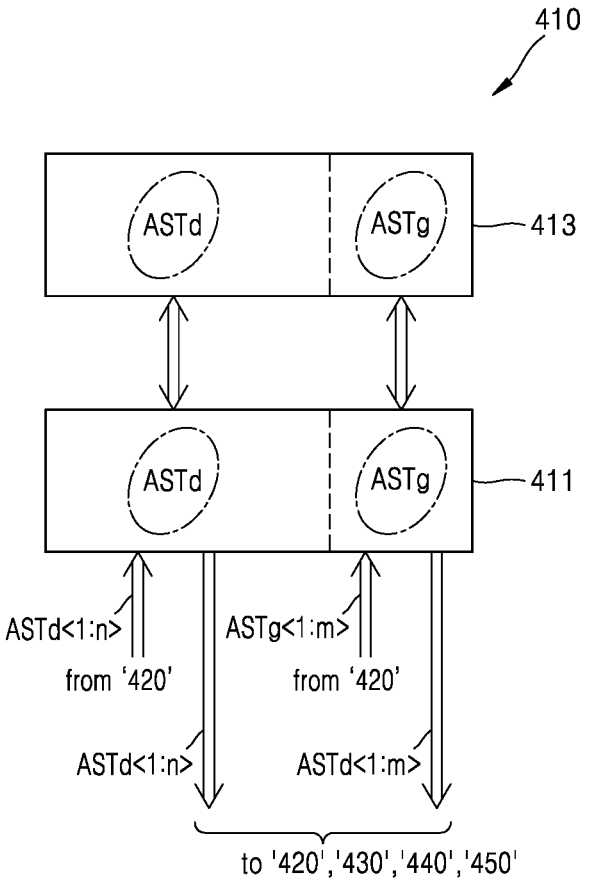
FIG. 7 is a schematic view illustrating a cumulative stress storage unit of FIG. 6.

FIG. 7 is a schematic view illustrating the cumulative stress storage unit 410 of FIG. 6. Referring to FIG. 7, the cumulative stress storage unit 410 includes a volatile memory 411 and a non-volatile memory 413.

The volatile memory 411 has a relatively faster-operating speed than the non-volatile memory 413. The volatile memory 411 stores the image cumulative stress indexes ASTd of the display pixels PIXd and communicates with the stress confirmation update unit 420, the correlation confirmation unit 430, the degradation compensation unit 440, and the data setting signal generating unit 450.

Here, the image cumulative stress index ASTd of each of the display pixels PIXd are updated by adding a corresponding image unit stress index USTd (referring to FIG. 6) in the current frame. In addition, the aging cumulative stress index ASTg of each of the aging pixels PIXg are updated by adding a corresponding aging unit stress index USTg (referring to FIG. 6) in the current frame.

The volatile memory 411 may be a static random access memory (SRAM).

The non-volatile memory 413 communicates with the volatile memory 411. In addition, the non-volatile memory 413 stores the image cumulative stress indexes ASTd and the aging cumulative stress indexes ASTg even when power is turned off.

The non-volatile memory 413 may be a flash memory.

In the volatile memory 411 and the non-volatile memory 413, the image cumulative stress indexes ASTd and the aging cumulative stress indexes ASTg may be stored in different memory devices.

Referring to FIG. 6 again, the stress confirmation update unit 420 confirms the image unit stress indexes USTd of each of the display pixels PIXd and the aging unit stress indexes USTg of each of the aging pixels PIXg.

Each of the image unit stress indexes of each of the display pixels PIXd corresponds to the original image data DATQRd of each of the display pixels PIXd. Each of the aging unit stress indexes of each of the aging pixels PIXg corresponds to the original aging data DATQRg of each of the aging pixels PIXg.

The stress confirmation update unit 420 is driven to update the image cumulative stress indexes ASTd and the aging cumulative stress indexes ASTg stored in the cumulative stress storage unit 410.

In an embodiment, the stress confirmation update unit 420 may include a unit stress confirmation device 421 and a stress adding device 423.

The unit stress confirmation device 421 confirms the original image data DATQRd of each of the display pixels PIXd and generates the image unit stress indexes USTd of each of the display pixels PIXd. The unit stress confirmation device 421 confirms the original aging data DATQRg of each of the aging pixels PIXg and generates the aging unit stress indexes USTg of each of the aging pixels PIXg.

The stress adding device 423 updates the image cumulative stress indexes ASTd by adding the image unit stress index of each of the display pixels PIXd. The stress adding device 423 updates the aging cumulative stress indexes ASTg by adding the aging unit stress index of each of the aging pixels PIXg.

The correlation confirmation unit 430 confirms a correlation between the aging cumulative stress index ASTg and the degradation sensed value VSEN of each of the aging pixels PIXg and generates sensing correlation information IFSN that is information on the correlation.

The degradation compensation unit 440 stores the degradation correlation information IFDE. The degradation correlation information IFDE is updated using the sensing correlation information IFSN.

The degradation compensation unit 440 compensates for the degradation of the original image data DATQRd of each of the display pixels PIXd based on the degradation confirmation value FVA for a standard cumulative stress index RPST corresponding to the image cumulative stress index ASTd of each of the display pixels PIXd to generate the image driving data DATDRd of each of the display pixels PIXd.

The degradation compensation unit 440 compensates for the degradation of the original aging data DATQRg of the each of the aging pixels PIXg based on the degradation confirmation value FVA for the standard cumulative stress index RPST corresponding to the aging cumulative stress index ASTg of each of the aging pixels PIXg to generate the aging driving data DATDRg each of the aging pixels PIXg.

FIG. 8 is a schematic view illustrating the degradation compensation unit 440 of FIG. 6. Referring to FIG. 8, the degradation compensation unit 440 includes a degradation look-up table 441, a confirmed value amplifying device 443, and a degradation compensation device 445.

The degradation look-up table 441 stores the degradation correlation information IFDE. The degradation look-up table 441 outputs the degradation confirmation values FVA corresponding to the image cumulative stress indexes ASTd of each of the display pixels PIXd and the aging cumulative stress indexes ASTg of each of the aging pixels PIXg.

The confirmed value amplifying device 443 amplifies the degradation confirmation values FVA output from the degradation look-up table 441 to a predetermined gain (e.g., 10) and generates amplification confirmation values PVA. Since the degradation confirmation values FVA are amplified, the degradation compensation in the degradation compensation device 445 is facilitated.

The degradation compensation device 445 generates the image driving data DATDRd of each of the display pixels PIXd by compensating for the degradation of the original image data DATQRd of each of the display pixels PIXd. The degradation compensation device 445 generates the aging driving data DATDRg of each of the aging pixels PIXg by compensating for the degradation of the original aging data DATQRg of each of the aging pixels PIXg.

The compensation for the degradation of the original image data DATQRd and the original aging data DATQRg in the degradation compensation device 445 is performed based on the amplification confirmation values PVA of the original image data DATQRd and the original aging data DATQRg output from the degradation look-up table 441.

The data setting signal generating unit 450 generates the data setting signal XDASET (referring to FIG. 6). The data setting signal XDASET may be activated, for example, as described above with reference to FIG. 5.

Hereinafter, the compensation for the degradation of original image data DATQRd of a display pixel PIXd <i> is described.

FIG. 9 is a view for describing an example of the compensation for the degradation of the original image data DATQRd of the display pixel PIXd <i> in FIG. 1.

For example, in an image cumulative stress index ASTd <i> of the display pixel PIXd <i> (where i is a natural number of 1 or more and n or less), when the standard cumulative stress index RPST corresponds to 20, a degradation confirmation value FVA of the display pixel PIXd <i> is confirmed as 0.13 V. Also, an amplification confirmation value PVA is 1.3 V.

Here, a degradation compensation value CVA for the display pixel PIXd <i> is confirmed as 13.

In this case, when a data value of the original image data DATQRd of the display pixel PIXd <i> is 142, the image driving data DATDRd is determined to be 155=(142+13).

Figure 10:
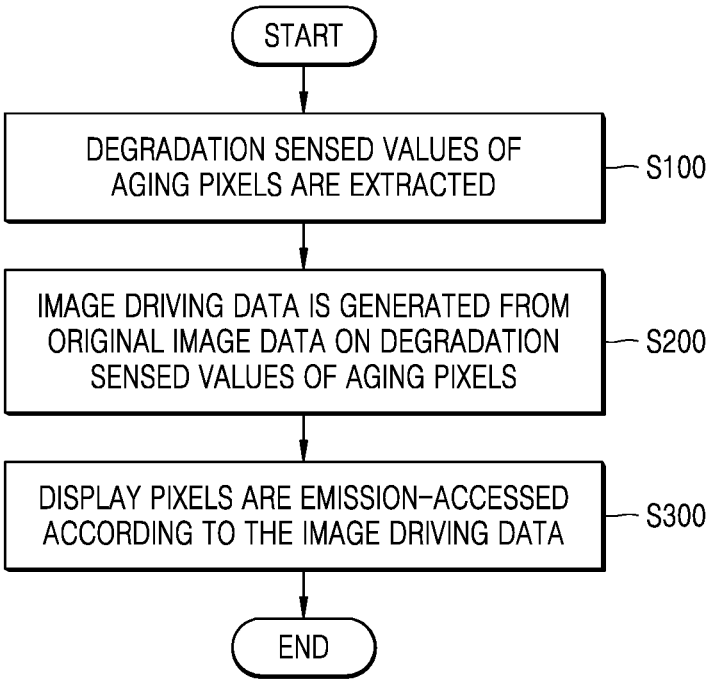
FIG. 10 is a flowchart for describing an operation of the OLED device.

FIG. 10 is a flowchart for describing an operation of the OLED device according to an embodiment.

First, in an operation of S100, degradation sensed values VSEN of aging pixels PIXg are extracted while a degradation sensing operation proceeds.

In an operation of S200, image driving data DATDRd is generated from original image data DATQRd of the display pixels PIXd based on the extracted degradation sensed values VSEN of the aging pixels PIXg.

In an operation of S300, the display pixels PIXd are emission-accessed according to the image driving data DATDRd while an image display operation proceeds.

In the disclosure, in relation to the degradation compensation method, the embodiments are illustrated and described, in which the degradation compensation value CVA according to the degree of degradation is generated, and the degradation compensation value CVA is added to the generated original image data DATQRd to generate the image driving data DATDRd.

However, the embodiments are not limited thereto. In other embodiments, the degradation compensation may be implemented such that gains are generated according to the degree of degradation and the generated gains are multiplied by original image data DATQRd to generate image driving data DATDRd.

In the above embodiments of OLED device, aging pixels for identifying the degree of degradation are disposed in a different area from display pixels for displaying images. Thus, an aperture ratio can be greatly improved. Further, the aging pixels are degraded by reflecting data values of image driving data of the display pixels in each frame. The degree of degradation is directly sensed through the aging pixels, and the degree of degradation sensed is reflected in degradation compensation for the display pixels. Thus, the accuracy of the degradation compensation for the display pixels can be greatly improved.

As a result, according to the OLED device of the disclosure, the degree of degradation of the pixels can be accurately reflected while having a high aperture ratio, that is, effective degradation compensation can be performed.

In concluding the detailed description, those skilled in the art will appreciate that many variations and modifications may be made to the embodiments without substantially departing from the principles and spirit and scope of the disclosure. Therefore, the disclosed embodiments are used in a generic and descriptive sense only and not for purposes of limitation.

What is claimed is:

1. An organic light-emitting display (OLED) device comprising:

an image display member including display pixels which are driven to display images for each frame in an image display operation and each of which is emission-accessed according to image driving data;

an aging display member including aging pixels each of which is driven to read a degradation sensed value reflecting a degree of degradation of each aging pixel in a degradation sensing operation; and a degradation compensation control member that stores degradation correlation information representing a degradation confirmation value for each of standard cumulative stress indexes and being updated depending on the degradation sensed value, the degradation compensation control member compensating for degradation of original image data of each display pixel according to the degradation correlation information to provide the image driving data of each display pixel, wherein the aging pixels are driven to be degraded by reflecting the image driving data of the display pixels in each frame, and the degradation of the original image data is compensated depending on the degradation confirmation values of the standard cumulative stress indexes corresponding to image cumulative stress indexes which represent cumulative stress of the display pixels.

2. The OLED device of claim 1, wherein each of the aging pixels is emission-accessed according to aging driving data in the image display operation in which the degradation sensing operation is not performed, the degradation compensation control member includes:

an aging data generator that generates original aging data of each of the aging pixels based on the original image data of each of the display pixels; and a degradation compensation controller that stores the degradation correlation information, compensates for the degradation of the original image data of each of the display pixels using the degradation correlation information to generate the image driving data of each of the display pixels, and compensates for degradation of the original aging data of each of the aging pixels to generate the aging driving data of each of the aging pixels, and the degradation of the original aging data is compensated depending on the degradation confirmation values of the standard cumulative stress indexes corresponding to aging cumulative stress indexes which represent cumulative stress of the aging pixels.

3. The OLED device of claim 2, wherein the original aging data of each of the aging pixels in a current frame is determined based on a maximum data value among the original image data of each of the display pixels in the current frame.

4. The OLED device of claim 2, wherein the degradation compensation controller includes:

a cumulative stress storage unit that stores the image cumulative stress indexes of the display pixels and the aging cumulative stress indexes of the aging pixels;

a stress confirmation update unit that updates the image cumulative stress indexes and the aging cumulative stress indexes stored in the cumulative stress storage unit by confirming image unit stress indexes of each of the display pixels and aging unit stress indexes of each of the aging pixels, wherein each of the image unit stress indexes corresponds to the original image data of each of the display pixels, and each of the aging unit stress indexes corresponds to the original aging data of each of the aging pixels;

a correlation confirmation unit that confirms a correlation between the aging cumulative stress index and the degradation sensed value of each of the aging pixels to generate sensing correlation information; and a degradation compensation unit that stores the degradation correlation information, compensates for the degradation of the original image data of each of the display pixels based on the degradation confirmation value for the standard cumulative stress index corresponding to the image cumulative stress index of each of the display pixels to generate the image driving data of each of the display pixels, compensates for the degradation of the original aging data of each of the aging pixels based on the degradation confirmation value for the standard cumulative stress index corresponding to the aging cumulative stress index of each of the aging pixels to generate the aging driving data of each of the aging pixels, wherein the degradation correlation information of the degradation compensation unit is updated using the sensing correlation information.

5. The OLED device of claim 4, wherein the cumulative stress storage unit includes:

a volatile memory that stores the image cumulative stress indexes of the display pixels and the aging cumulative stress indexes of the aging pixels and communicates with the stress confirmation update unit, the correlation confirmation unit, and the degradation compensation unit, wherein the image cumulative stress indexes of each of the display pixels are updated depending on the corresponding image unit stress indexes, and the aging cumulative stress indexes of each of the aging pixels are updated depending on the corresponding aging unit stress indexes; and a non-volatile memory that stores the image cumulative stress indexes and the aging cumulative stress indexes even when power is off and communicates with the volatile memory.

6. The OLED device of claim 4, wherein the stress confirmation update unit includes:

a unit stress confirmation device that confirms the original image data of each of the display pixels to generate the image unit stress indexes of each of the display pixels and confirms the original aging data of each of the aging pixels to generate the aging unit stress indexes of each of the aging pixels; and a stress adding device that updates the image cumulative stress indexes of each of the display pixels by adding the image unit stress index of each of the display pixels and updates the aging cumulative stress indexes of each of the aging pixels by adding the aging unit stress indexes of each of the aging pixels.

7. The OLED device of claim 4, wherein the degradation compensation unit includes;

a degradation look-up table that stores the degradation correlation information and outputs the degradation confirmation value corresponding to the image cumulative stress index of each of the display pixels and the aging cumulative stress index of each of the aging pixels;

a confirmed value amplifying device that generates an amplification confirmation value by amplifying the degradation confirmation value output from the degradation look-up table; and a degradation compensation device that compensates for the degradation of the original image data of each of the display pixels to generate the image driving data of each of the display pixels and compensates for the degradation of the original aging data of each of the aging pixels to generate the aging driving data of each of the aging pixels, wherein the degradation of the original image data and the compensation for the degradation of the original aging data are compensated by the degradation compensation device based on the amplification confirmation values of the original image data and the original aging data, respectively, that are output from the confirmed value amplifying device.

8. The OLED device of claim 4, wherein the degradation compensation controller further includes a data setting signal generating unit that generates a data setting signal that is activated in a previous frame based on the image cumulative stress indexes and the aging cumulative stress indexes, and the aging data generator that determines the original aging data of each of the aging pixels in a current frame based on the image cumulative stress indexes and the aging cumulative stress indexes according to the activation of the data setting signal.

9. The OLED device of claim 1, wherein each of the aging pixels of the aging display member emits light according to aging driving data in the image display operation, and the aging driving data of each of the aging pixels is determined based on the original image data of each of the display pixels.

10. The OLED device of claim 9, wherein the aging driving data of each of the aging pixels is generated by compensating for degradation of original aging data of each of the aging pixels, and the original aging data of each of the aging pixels is generated based on the original image data of each of the display pixels.

11. The OLED device of claim 10; wherein the original aging data of each of the aging pixels is generated based on the image cumulative stress indexes of each of the display pixels.

12. The OLED device of claim 10, wherein the compensation for the degradation of the original aging data is performed depending on the degradation sensed values of the aging pixels.

* * * * *